US008465331B2

(12) United States Patent
Shimowake et al.

(10) Patent No.: US 8,465,331 B2
(45) Date of Patent: Jun. 18, 2013

(54) POWER TERMINAL BLOCK AND POWER SUPPLY APPARATUS

(75) Inventors: Keishi Shimowake, Kawasaki (JP); Yoshinori Hoshino, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 92 days.

(21) Appl. No.: 13/247,511

(22) Filed: Sep. 28, 2011

(65) Prior Publication Data

US 2012/0080939 A1 Apr. 5, 2012

(30) Foreign Application Priority Data

Sep. 30, 2010 (JP) ..... 2010-220561

(51) Int. Cl.
*H01R 9/22* (2006.01)

(52) U.S. Cl.
USPC ..... 439/709

(58) Field of Classification Search
USPC ..... 439/709–721, 532
See application file for complete search history.

(56) References Cited

U.S. PATENT DOCUMENTS

| | | | | |
|---|---|---|---|---|
| 7,837,517 | B2 * | 11/2010 | Lewis | 439/709 |
| 8,197,288 | B1 * | 6/2012 | Patel et al. | 439/709 |
| 8,337,257 | B2 * | 12/2012 | Kaneshiro | 439/709 |

FOREIGN PATENT DOCUMENTS

| | | | |
|---|---|---|---|
| JP | 07-220782 | A | 8/1995 |
| JP | 2001-167825 | A | 6/2001 |
| JP | 2003-068379 | A | 3/2003 |

* cited by examiner

*Primary Examiner* — Khiem Nguyen
(74) *Attorney, Agent, or Firm* — Fujitsu Patent Center

(57) ABSTRACT

A power terminal block includes a base made of an insulator, a plurality of power terminals electrically insulated from each other and disposed on the base, and a plurality of terminal bases, each terminal base including a base connecting part made of a conductor and electrically coupled to the power terminals, and a first conductor connecting part made of a conductor, the first conductor connecting part being physically and electrically coupled to the base connecting part, the base connecting part and the first conductor connecting part being provided at different heights, wherein adjoining terminal bases, electrically coupled to power terminals supplied with currents with different electrical potentials, are coupled with the first conductor connecting parts of adjoining terminal bases disposed in different directions.

8 Claims, 6 Drawing Sheets

POWER TERMINAL BLOCK AND POWER SUPPLY APPARATUS

CROSS-REFERENCE TO RELATED APPLICATIONS

This application is based upon and claims the benefit of priority of the prior Japanese Patent Application No. 2010-220561, filed on Sep. 30, 2010, the entire contents of which are incorporated herein by reference.

FIELD

The present invention relates to a power terminal block that receives electrical power and a power supply apparatus that distributes electrical power from a power terminal block to functional blocks.

BACKGROUND

A power terminal block distributes an electrical current to a plurality of functional blocks in an apparatus. A power terminal block mounted on a transmission apparatus has a plurality of terminals for distributing electrical power to functional blocks in the transmission apparatus. Electrical currents are supplied to the functional blocks by connecting power cables to the terminals.

In the transmission apparatus, a larger current is distributed through the power terminal block to the functional blocks. Recently, there is a need for an increase in the throughput of transmission apparatuses due to an increasing demand for Internet communication. To increase throughput, the speed of electrical signals must be increased. To increase the speed, the current consumption by each apparatus is at least doubled compared with apparatuses according to the related art. For example, an apparatus that has been supplied 30 A will required a current of at least 70 A.

SUMMARY

According to an aspect of the disclosed embodiments, a power terminal block includes a base made of an insulator, a plurality of power terminals electrically insulated from each other and disposed on the base, and a plurality of terminal bases, each terminal base including a base connecting part made of a conductor and electrically coupled to the power terminals, and a first conductor connecting part made of a conductor, the first conductor connecting part being physically and electrically coupled to the base connecting part, the base connecting part and the first conductor connecting part being provided at different heights, wherein adjoining terminal bases, electrically coupled to power terminals supplied with currents with different electrical potentials, are coupled with the first conductor connecting parts of adjoining terminal bases disposed in different directions.

The object and advantages of the disclosed embodiments will be realized and attained by at least the features, elements, and combinations particularly pointed out in the claims.

It is to be understood that both the foregoing general description and the following detailed description are exemplary and explanatory and are not restrictive of the disclosed embodiments, as claimed.

DESCRIPTION OF EMBODIMENTS

To reduce the size of a transmission apparatus, high-density implementation is required. To distribute a large current to functional blocks in an apparatus, such as a transmission apparatus, the diameter of power cables must be increased. An increase in the diameter of a power cable causes an increase in the bend radius of the power cable, thus causing an increase in the space required for the cable distribution. As a result, size reduction of the power supply apparatus is prevented.

Also, flexibility of the power cable is reduced, making the procedure of cable distribution difficult. If the clamps attached to the terminal block receiving power are disposed at intervals the same as the intervals of the terminal blocks, depending on the directionality of the connected distribution power cables, a sufficient insulating distance cannot be ensured, and operability is reduced.

Known terminal bases are directly screwed to power terminals, and conductor connection parts of adjoining terminal bases, which are connected to the power cables, are on the same plane. Therefore, each terminal base might contact the adjoining terminal bases and/or the power cables connected to the terminal bases. In other words, the working area is limited.

In addition, screws may loosen when power cables are direction connected to the connection holes in the power terminal block and/or physical factors, such as the thickness of the power cables and the distance between adjoining connection holes, may hinder the connection. Such factors hinder high-density implementation on the apparatus on which the power terminal block is mounted.

An embodiment of the present invention will be described below with reference to the accompanying drawings.

Figure 1:
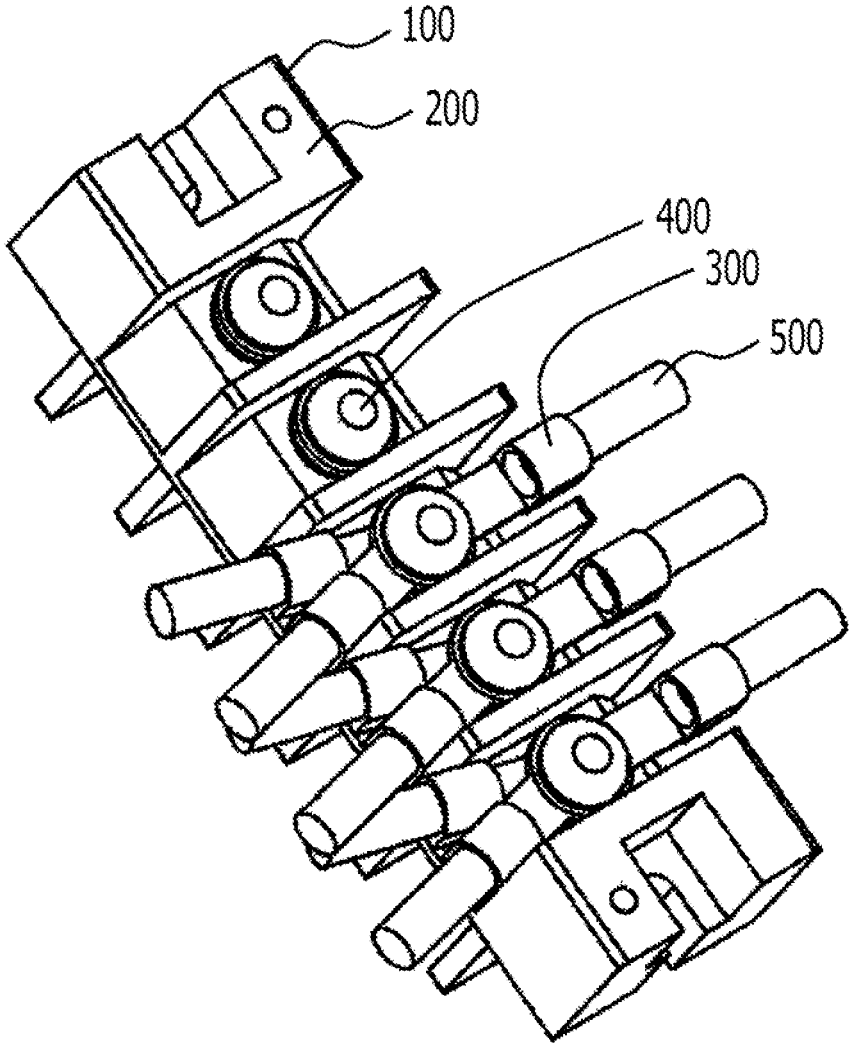
FIG. 1 is a perspective view of a power terminal block connected to power cables.

FIG. 1 illustrates a known power terminal block to which power distribution cables are coupled.

The power terminal block 100 branches a power source and supplies power to a plurality of loads. The power terminal block 100 includes a base 200 made of an insulator, connectors 300 made of a conductor and connected to power distribution cables 500 that supply power to the loads, and connection holes formed in the base 200. The connectors 300 are secured to the base 200 with clamps 400.

Details of the power terminal block will be described below.

Figure 2:
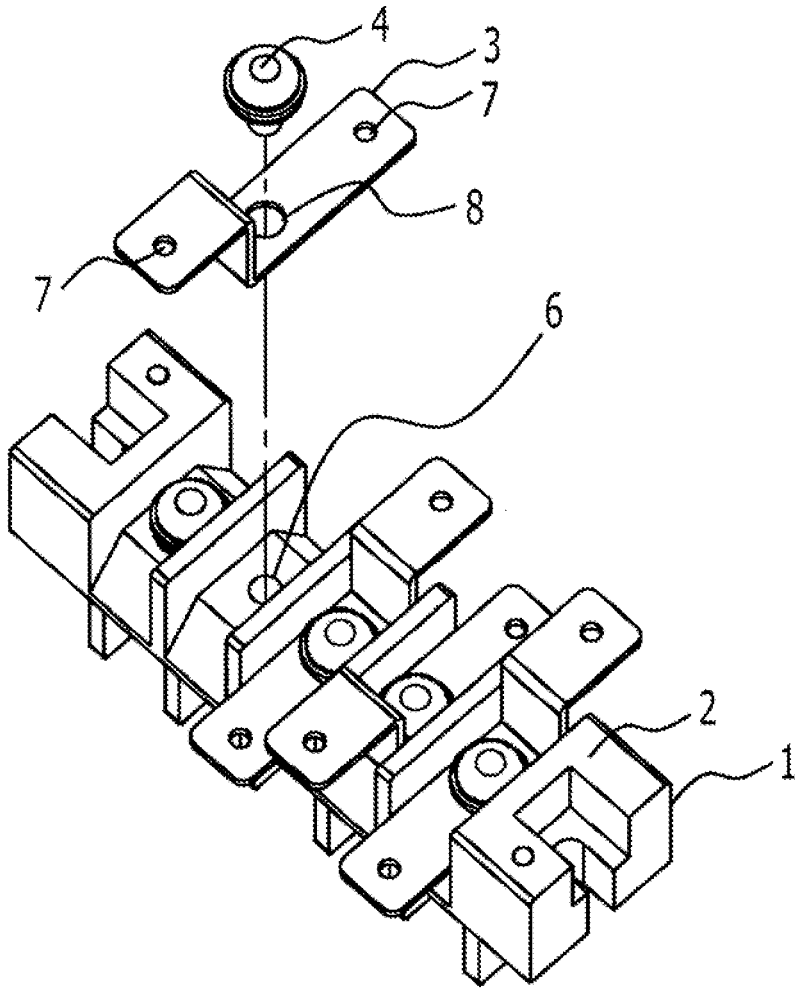
FIG. 2 is a perspective view of a power terminal block having terminal bases.

A power terminal block is illustrated in FIG. 2. The power terminal block 1 according to the present invention includes a base 2 made of an insulator and having connection holes without any electrical contact, terminal bases 3 made of a conductor, and clamps 4 that secure the terminal bases 3 to the base 2 by being inserted in base connection holes 6 in the base 2. The base connection holes 6 include power terminals. The terminal bases 3 have cable connection holes 7 to which power supply cables are connected to branch and supply electrical power to loads. The power supply cable may be electrically coupled to the cable connection holes 7. The terminal bases 3 have securing holes 8 for securing the terminal bases 3 to the connection holes 6 in the base 2 with the clamps 4. The connection holes 6 penetrate the base 2 so that the terminal bases 3 can be coupled to the connection holes 6 on the back side of the base 2, which is the side not shown in the drawing. The connection holes 6 shown in the drawing are used for input, and the connection holes 6 on the side not shown in the drawing are used for distribution.

Figure 3:
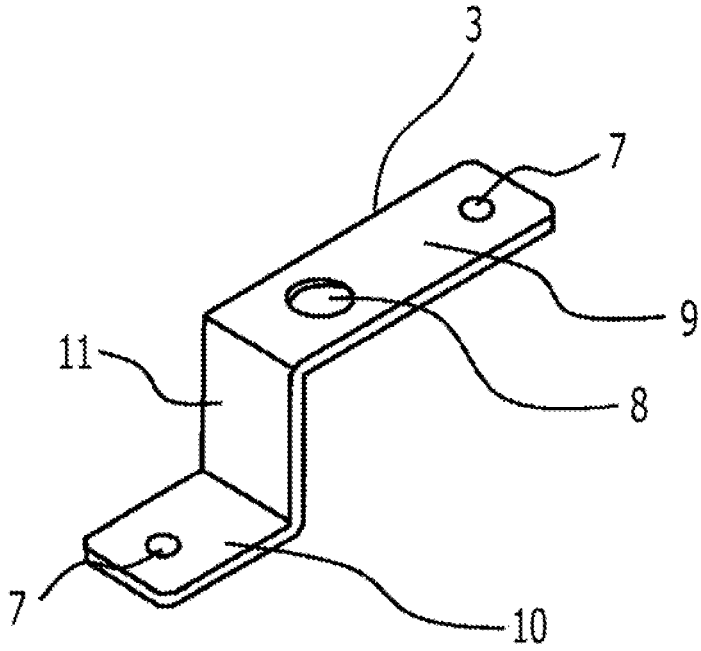
FIG. 3 is perspective view of a terminal base.

A terminal base on a power terminal block will be described in detail below. FIG. 3 illustrates a terminal base 3. The terminal base 3 has a first flat part 9 in which a securing hole 8 and a cable connection hole 7 are formed. The terminal base 3 has a second flat part 10 in which a cable connection hole 7 is formed. The second flat part 10 is secured to the base 2 at a height different from that of the first flat part 9. The terminal base 3 also has a third flat part 11, which connects the first flat part 9 and the second flat part 10. A current of the same electrical potential flows through the first flat part 9, the second flat part 10, and the third flat part 11. The first flat part 9, the second flat part 10, and the third flat part 11 may be provided as a single unit or each part may be produced separately and then joined together. The connection holes 7 are positioned such that, when the terminal base 3 is secured to the power terminal block 1, the connection holes are positioned outside the base 2 when viewed in the direction of the axis of the connection holes 7. The connection holes 7 may also be used as conductor connection holes for metal plates and metal rods.

Figure 4:
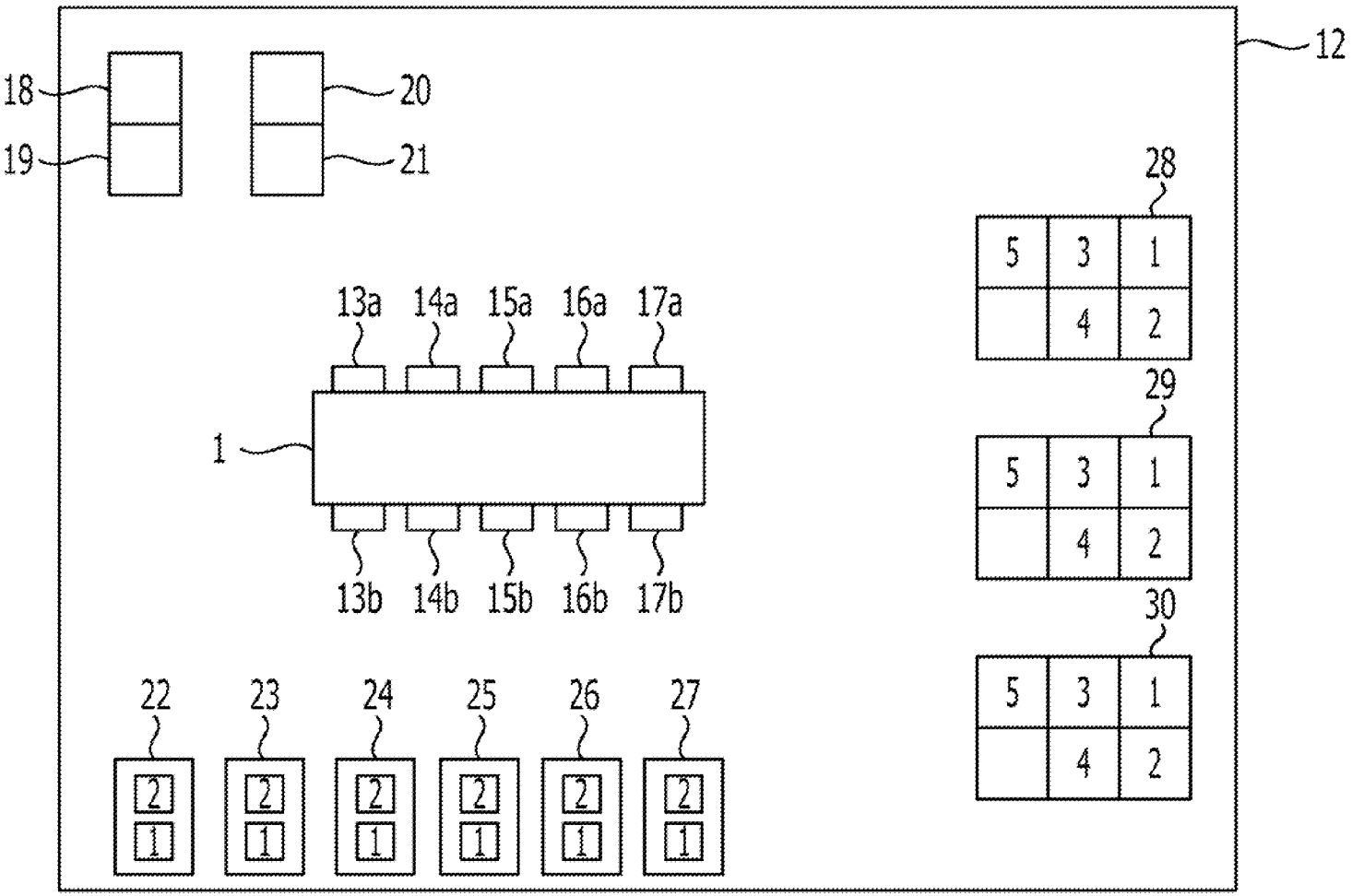
FIG. 4 is functional block diagram of a power supply apparatus having a power terminal block.

FIG. 4 is a functional block diagram of a power supply apparatus including a power terminal block. Such a power supply apparatus is used in, for example, an undersea communication apparatus using optical transmission. In the power supply apparatus, power distribution cables are connected to the power terminal block, which is a power input unit of the power supply apparatus, to distribute power to subracks, which are functional blocks in the power supply apparatus, via an overcurrent protection device. The power distribution cables may be coupled to the power terminal block, The power supply apparatus 12 including a power terminal block according to the present invention includes a power terminal block 1 connected to, for example, a station feeding apparatus. Power cables connected to the power terminal block 1 are connected to distribution boards to distribute the electrical current supplied from the station to the functional blocks. The power terminal block 1 includes the following connection terminals: first power system (MAIN 1) terminals 13*a* and 13*b*, second power system (MAIN 2) terminals 14*a* and 14*b*, first ground (G1) terminals 15*a* and 15*b*, second ground (G2) terminals 16*a* and 16*b*, and frame ground (FG) terminals 17*a* and 17*b*. Each connection terminal has a connection hole and a terminal base. A clamp is passed through the connection hole to secure the connection terminal to the terminal base. The connection holes 6 illustrated in FIG. 2 are the connection terminals. The connection holes 6 illustrated in FIG. 2 correspond to connection terminals 13*a* to 17*a*, whereas the connection holes 6 not visible in the drawing correspond to the connection terminals 13*b* to 17*b*.

For example, in the power supply apparatus 12 illustrated in FIG. 4, electrical power is supplied a station feeding unit connected to the station feeding apparatus to the power terminal block 1 via power distribution cables. The station feeding unit receives power from the station power feeding apparatus via a back wiring board (BWB). The station feeding unit has a wire 18 that supplies, for example, −48 V to the first power system terminal 13*b* of the power terminal block 1 via a power cable. The station feeding unit has a wire 19 that is connected to the first ground terminal 15*b* of the power terminal block 1 via a power cable. The station feeding unit has a wire 20 that supplies, for example, −48 V to the second power system terminal 14*b* of the power terminal block 1 via a power cable. The station feeding unit has a wire 21 that is connected to the second ground terminal 16*b* of the power terminal block 1 via a power cable.

The power supply apparatus includes fuse holders 22 to 27, each having a first terminal and a second terminal. When an overcurrent is accidentally applied, a fuse, which is an overcurrent protection device, fuses by Joule heat and blocks the overcurrent.

The second terminal of the fuse holder 22 receives electrical power from the first power system terminal 13*a* of the power terminal block 1 via a power cable or a metal bar. The power supplied to the second terminal of the fuse holder 22 is further supplied from the first terminal to a first terminal of the distribution board 28 via a power cable. First to fifth terminals of the distribution board 28 are connected to power terminals on a lower section of a subrack of a communication apparatus.

The second terminal of the fuse holder 23 receives electrical power from the second power system terminal 14*a* of the power terminal block 1 via a power cable or a metal bar. The power supplied to the second terminal of the fuse holder 23 is further supplied from the first terminal to the second terminal of the distribution board 28 via a power cable.

The second terminal of the fuse holder 24 receives electrical power from the first power system terminal 13*a* of the power terminal block 1 via a power cable or a metal bar. The power supplied to the second terminal of the fuse holder 24 is further supplied from the first terminal to a first terminal of a distribution board 29 via a power cable. First to fifth terminals of the distribution board 29 are connected to power terminals on a middle section of the subrack of the communication apparatus.

The second terminal of the fuse holder 25 receives electrical power from the second power system terminal 14*a* of the power terminal block 1 via a power cable or a metal bar. The power supplied to the second terminal of the fuse holder 25 is further supplied from the first terminal to the second terminal of the distribution board 29 via a power cable.

The second terminal of the fuse holder 26 receives electrical power from the first power system terminal 13*a* of the power terminal block 1 via a power cable or a metal bar. The power supplied to the second terminal of the fuse holder 26 is further supplied from the first terminal to a first terminal of a distribution board 30 via a power cable. First to fifth terminals of the distribution board 30 are connected to power terminals on the middle section of the subrack of the communication apparatus.

The second terminal of the fuse holder 27 receives electrical power from the second power system terminal 14*a* of the power terminal block 1 via a power cable or a metal bar. The power supplied to the second terminal of the fuse holder 27 is further supplied from the first terminal to the second terminal of the distribution board 30 via a power cable.

The first ground terminal 15*b* of the power terminal block 1 is connected to a third terminal of the distribution board 28, a third terminal of the distribution board 29, and a third terminal of the distribution board 30. The second ground terminal 16*b* of the power terminal block 1 is connected to a fourth terminal of the distribution board 28, a fourth terminal of the distribution board 29, and a fourth terminal of the distribution board 30. The frame ground terminal 17*b* of the power terminal block 1 is connected to a fifth terminal of the distribution board 28, a fifth terminal of the distribution board 29, and a fifth terminal of the distribution board 30.

Figure 5:
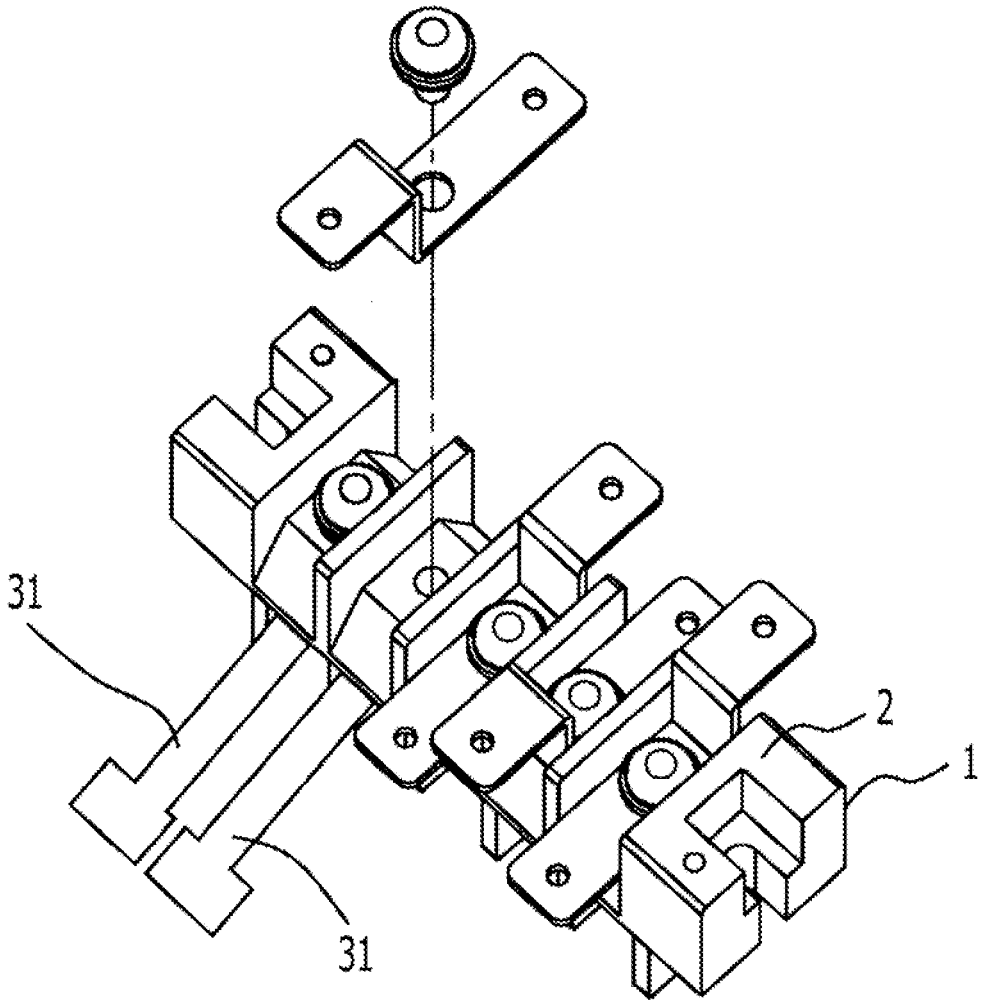
FIG. 5 is perspective view of a power terminal block having metal bars.

FIG. 5 is a perspective view of a power terminal block having metal bars. The power terminal block has metal bars 31 made of a conductor. For example, the metal bars 31 are made of copper plates plated with nickel. The metal bars 31 are connected to, for example, the first power system (MAIN 1) terminals 13 and the second terminals of the fuse holders 22, 24, and 26 in the power terminal block, which are illustrated in FIG. 4. The metal bars 31 are also connected to the second power system (MAIN 2) terminals 14 and the second terminals of the 23, 25, and 27 of the power terminal block.

Figure 6:
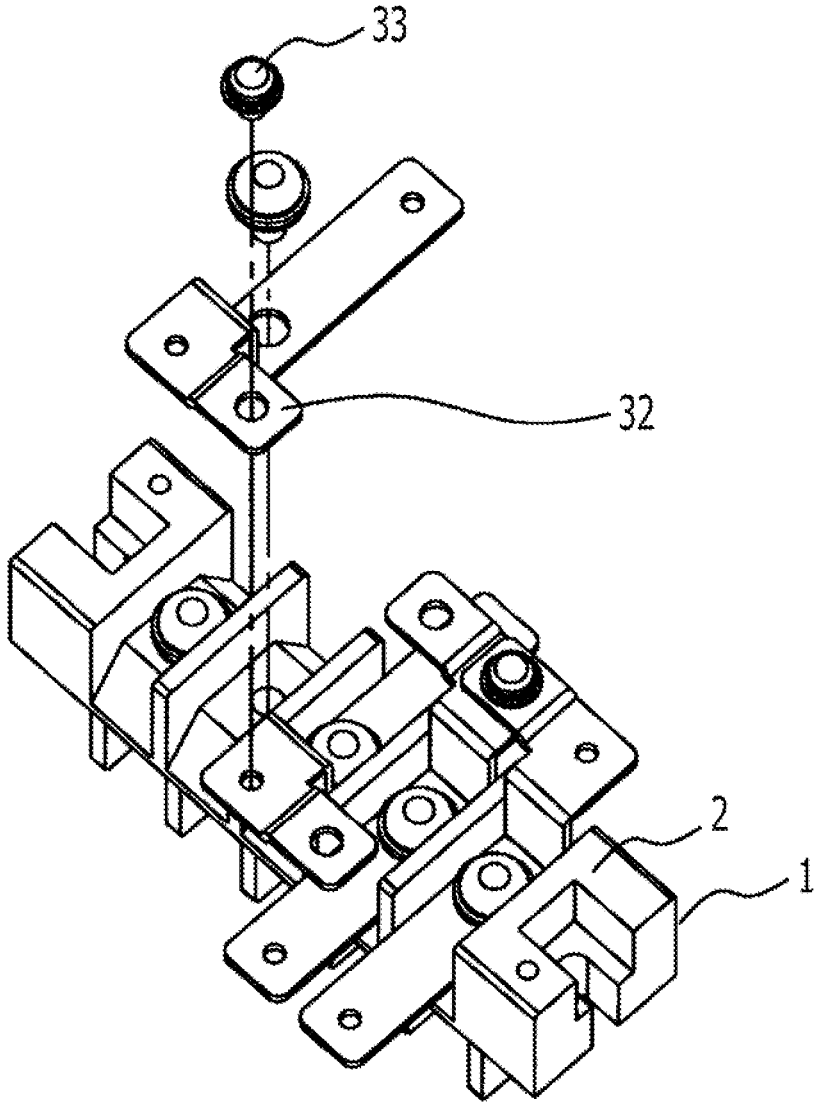
FIG. 6 is a perspective view of a power terminal block.

FIG. 6 illustrates a power terminal block.

The terminal bases attached to the power terminal block each have a fourth flat part 32, which is connected to an adjoining terminal base. The fourth flat part 32 and the adjoining terminal base are secured with a clamp 33.

When securing the terminal bases to adjoining connection holes in the power supply apparatus, the terminal bases are secured alternately such that the first flat parts of the terminal bases are not positioned on the same side of the power terminal block. In this way, the power distribution cables connected to adjoining terminal bases are less likely to contact each other. In addition, the procedure of connecting the power distribution cables to the terminal bases becomes easier.

By alternately attaching the terminal bases, a sufficient insulating distance can be maintained easily within a small space. Additionally, by extending the terminal base, a plurality of power cables can be connected.

By attaching the terminal bases to adjoining terminals, which use terminal bases with the same electrical potential, in the same direction, the adjoining terminals can be connected.

By increasing the number of cable connection holes to which power distribution cables are connected, a plurality of power cables can be connected. Power cables that supply power via a BWB can be accommodated in a casing in a compact manner and can be efficiently distributed.

By inverting the attachment direction of the terminal base for each electrode, a sufficient insulating distance can be maintained with a single structure.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments have been described in detail, it should be understood that the various changes, substitutions, and alterations could be made hereto without departing from the spirit and scope of the invention.

What is claimed is:

1. A power terminal block comprising:
a base made of an insulator;
a plurality of power terminals electrically insulated from each other and disposed on the base; and
a plurality of terminal bases, each terminal base including
a base connecting part made of a conductor and electrically coupled to the power terminals, and
a first conductor connecting part made of a conductor, the first conductor connecting part being physically and electrically coupled to the base connecting part, the base connecting part and the first conductor connecting part being provided at different heights,
wherein adjoining terminal bases, electrically coupled to power terminals supplied with currents with different electrical potentials, are coupled with the first conductor connecting parts of adjoining terminal bases disposed in different directions.

2. The power terminal block according to claim 1, wherein the base connecting part of each terminal base has a second conductor connecting part extending in a direction different from the extending direction of the first conductor connecting part.

3. The power terminal block according to claim 2, further comprising:
terminal-base connection parts extending from the first conductor connection parts or the second conductor connection parts in the alignment direction of the power terminals, each terminal-base connection parts being electrically coupled to adjoining terminal bases electrically coupled to power terminals coupled to currents with the same electrical potential, the first conductor connection parts or the second conductor connection parts being aligned in a direction different from the alignment direction of the power terminals provided on the base.

4. A power supply apparatus comprising:
a power terminal block including
a base made of an insulator,
a plurality of power terminals insulated from each other and disposed on the base, and
a plurality of terminal bases, each terminal base including
a base connecting part made of a conductor and electrically coupled to the power terminals, and
a first conductor connecting part made of a conductor,
the first conductor connecting part being physically and electrically coupled to the base connecting part,
the base connecting part and the first conductor connecting part being provided at different heights,
wherein adjoining terminal bases electrically coupled to power terminals supplied with currents with different electrical potentials are coupled with the first conductor connecting parts of adjoining terminal bases disposed in different directions;
a feeding unit coupled to an external power supply and supplying electrical power to the power terminal block;
an overcurrent protection device blocking an overcurrent supplied from the electrical power terminal block; and
a plurality of distribution boards receiving electrical power from the power terminal block via the overcurrent protection device and distributing the electrical power to coupled devices.

5. The power supply apparatus according to claim 4, wherein
the base connecting part of each terminal base has a second conductor connecting part extending in a direction different from the extending direction of the first conductor connecting part, and
the terminal bases have terminal-base connection parts extending from the first conductor connection parts or the second conductor connection parts in the alignment direction of the power terminals, each terminal-base connection parts being electrically coupled to adjoining terminal bases electrically coupled to power terminals coupled to currents with the same electrical potential, the first conductor connection parts or the second conductor connection parts being aligned in a direction different from the alignment direction of the power terminals provided on the base.

6. The power supply apparatus according to claim 4, further comprising:
conductive bars made of a flat conductor and connecting the power terminals and the overcurrent protection device.

7. The power supply apparatus according to claim 4, wherein the power terminals include power system terminals supplying electrical power, ground power terminals coupled to the ground, and frame ground power terminals.

8. A communication apparatus comprising:

a power supply apparatus including a power terminal block including a base made of an insulator, a plurality of power terminals insulated from each other and disposed on the base, and a plurality of terminal bases, each terminal base including a base connecting part made of a conductor and electrically coupled to the power terminals, and a first conductor connecting part made of a conductor, the first conductor connecting part being physically and electrically coupled to the base connecting part, base connecting part and the first conductor connecting part being provided at different heights, wherein adjoining terminal bases electrically coupled to power terminals supplied with currents with different electrical potentials are coupled with the first conductor connecting parts of adjoining terminal bases disposed in different directions, a feeding unit coupled to an external power supply and supplying electrical power to the power terminal block, an overcurrent protection device blocking an overcurrent supplied from the electrical power terminal block, and a plurality of distribution boards receiving electrical power from the power terminal block via the overcurrent protection device and distributing the electrical power to coupled devices.

* * * * *